US010260455B2

(12) United States Patent
Schmid et al.

(10) Patent No.: US 10,260,455 B2
(45) Date of Patent: Apr. 16, 2019

(54) MODULE WITH PRE-ORIENTED CAMSHAFT

(71) Applicant: ThyssenKrupp Presta TecCenter AG, Eschen (LI)

(72) Inventors: Heiko Schmid, Nendeln (LI); Ulrich Schatton, Feldkirch (AT); Hans Jürgen Schmidt, Tirschenreuth (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 193 days.

(21) Appl. No.: 15/301,919

(22) PCT Filed: Mar. 30, 2015

(86) PCT No.: PCT/EP2015/056902
§ 371 (c)(1),
(2) Date: Oct. 4, 2016

(87) PCT Pub. No.: WO2015/155050
PCT Pub. Date: Oct. 15, 2015

(65) Prior Publication Data

US 2017/0122252 A1 May 4, 2017

(30) Foreign Application Priority Data

Apr. 8, 2014 (DE) ..... 10 2014 104 995

(51) Int. Cl.
*F01L 1/02* (2006.01)
*F01L 1/46* (2006.01)
(Continued)

(52) U.S. Cl.
CPC ..... *F02F 7/0043* (2013.01); *F01L 1/053* (2013.01); *F01L 1/46* (2013.01); *F02F 1/24* (2013.01);
(Continued)

(58) Field of Classification Search
CPC ... F02F 7/0043; F02F 1/24; F01L 1/46; F01L 1/053; F01L 2250/04; F01L 2250/06
(Continued)

(56) References Cited

U.S. PATENT DOCUMENTS 2,480,866 A * 9/1949 Lusk ..... G01B 5/25 29/271
4,455,865 A * 6/1984 Davenport ..... F02B 77/087 33/600
(Continued)

FOREIGN PATENT DOCUMENTS

AU 2006201682 A1 5/2006
DE 19503105 C1 4/1996
(Continued)

OTHER PUBLICATIONS

English language Abstract for DE 19503105 C1.
(Continued)

*Primary Examiner* — J. Todd Newton
(74) *Attorney, Agent, or Firm* — thyssenkrupp North America, Inc.

(57) ABSTRACT

A module may include a receiving element in the form of a bearing frame or a covering hood for arrangement on a cylinder head of an internal combustion engine. The module may further include a camshaft that is rotatably mounted on the receiving element and projects from the receiving element to hold a camshaft wheel. The module can be prefabricated for direct mounting on the cylinder head. In the prefabrication process, the camshaft may be locked against rotation by an externally accessible securing part in an angular position for acting on valves. The securing part may extend through a first aperture in the camshaft wheel and
(Continued)

through or into a receptacle of the receiving element. After mounting the module on the cylinder head, the securing part can be removed.

13 Claims, 3 Drawing Sheets

(51) Int. Cl.
*F02F 1/24* (2006.01)
*F02F 7/00* (2006.01)
*F01L 1/053* (2006.01)

(52) U.S. Cl.
CPC . *F01L 2001/028* (2013.01); *F01L 2001/0537* (2013.01); *F01L 2103/00* (2013.01); *F01L 2103/01* (2013.01); *F01L 2103/02* (2013.01); *F01L 2250/04* (2013.01); *F01L 2250/06* (2013.01)

(58) Field of Classification Search
USPC ..... 123/90.16, 90.27
See application file for complete search history.

(56) References Cited

U.S. PATENT DOCUMENTS 4,570,334 A * 2/1986 Melzer ..... F01L 1/053 123/90.17
4,607,601 A * 8/1986 Kohler ..... F01L 1/02 123/195 C
4,619,027 A * 10/1986 Ohannesian ..... B25B 27/0035 29/275
5,099,563 A * 3/1992 Strusch ..... F01L 1/024 29/281.5
5,123,385 A * 6/1992 Sado ..... F01L 1/02 123/193.5
5,220,853 A * 6/1993 Sado ..... F01L 1/053 123/193.5
5,755,029 A * 5/1998 Learned ..... B25B 27/0035 29/402.03
5,845,397 A * 12/1998 Reedy ..... F01L 1/46 29/888.011
5,950,294 A * 9/1999 Gibbs ..... B25B 27/0035 269/199
6,058,585 A * 5/2000 Soleymani ..... B25B 27/0035 29/281.6
6,272,910 B1 * 8/2001 Noland ..... F01L 1/46 33/519
6,324,902 B1 * 12/2001 Kang ..... F01L 1/047 73/114.79
7,044,100 B2 * 5/2006 Stone ..... F01L 1/02 123/198 R
7,047,610 B2 * 5/2006 Dawson ..... F16H 7/24 269/249
7,707,983 B2 * 5/2010 Ueno ..... F01L 1/047 123/90.31
7,752,727 B2 * 7/2010 Mitchell ..... F16H 7/24 29/281.5
8,307,527 B2 * 11/2012 Huang ..... B25B 27/0035 29/281.5
8,495,978 B2 * 7/2013 Grossman ..... F16H 7/023 123/90.27
8,776,741 B2 * 7/2014 Neal ..... F01L 1/26 123/90.17
8,833,321 B2 * 9/2014 Sands ..... F01L 1/053 123/195 C
9,416,687 B2 * 8/2016 Menonna ..... F01L 1/047
9,447,706 B2 * 9/2016 Dautel ..... F01L 1/053
9,683,464 B2 * 6/2017 Schuler ..... F01L 1/047
9,981,304 B2 * 5/2018 Wiesner ..... B21D 53/845
2002/0023616 A1 * 2/2002 Stone ..... F01L 1/02 123/198 R
2004/0144349 A1 * 7/2004 Wampula ..... F01L 1/053 123/90.38
2006/0201464 A1 * 9/2006 Kira ..... F01L 1/3442 123/90.17
2006/0213045 A1 * 9/2006 Calviti ..... B25B 27/0035 29/281.5
2008/0047073 A1 * 2/2008 Martin ..... F01L 1/047 7/100
2008/0149064 A1 * 6/2008 Shibata ..... F01L 1/02 123/195 A
2008/0283018 A1 * 11/2008 Sakurai ..... B21D 53/845 123/195 R
2009/0044772 A1 * 2/2009 Purcilly ..... F01L 1/02 123/90.31
2011/0041790 A1 * 2/2011 Ilgeroth ..... F01L 1/053 123/90.27
2012/0222637 A1 * 9/2012 Neal ..... F01L 1/26 123/90.17
2015/0251238 A1 * 9/2015 Wiesner ..... F01L 1/053 29/888.1
2016/0108764 A1 * 4/2016 Leutert ..... F01L 1/047 123/90.6
2017/0122252 A1 * 5/2017 Schmid ..... F02F 7/0043
2017/0191444 A1 * 7/2017 Meusel ..... F02F 7/006

FOREIGN PATENT DOCUMENTS

| | | | |
|---|---|---|---|
| DE | 19815270 | A1 | 10/1999 |
| DE | 20120912 | U1 | 6/2002 |
| DE | 20313211 | U1 | 10/2003 |
| DE | 102007056608 | A1 | 6/2008 |
| DE | 102008037354 | A1 | 3/2009 |
| DE | 102008007091 | A1 | 8/2009 |
| DE | 102009049464 | A1 | 4/2011 |
| DE | 102011121860 | A1 | 6/2013 |
| DE | 10 2012 206 499 | A | 10/2013 |
| IN | 1327/CHE/2008 | | 11/2009 |
| JP | 2003194168 | A | 7/2003 |
| JP | 2010-19118 | A | 1/2010 |
| WO | 2004106716 | A1 | 12/2004 |

OTHER PUBLICATIONS

English language Abstract for DE 19815270 A1.
English language Abstract for DE 102008007091 A1.
English language Abstract for DE 102011121860A1.
Int'l Search Report for PCT/EP2015/056902 dated Jun. 4, 2015 (dated Jun. 12, 2015).
English Language Abstract for DE102007056608A1.

* cited by examiner

MODULE WITH PRE-ORIENTED CAMSHAFT

CROSS REFERENCE TO RELATED APPLICATIONS

This application is a U.S. National Stage Entry of International Patent Application Serial Number PCT/EP2015/056902, filed Mar. 30, 2015, which claims priority to German Patent Application No. DE 10 2014 104 995.0 filed Apr. 8, 2014, the entire contents of both of which are incorporated herein by reference.

FIELD

The present disclosure relates to camshaft modules to be mounted on cylinder heads of internal combustion engines.

BACKGROUND

The increasing wide variety of technologies used in the drive train of a vehicle demands of the engine manufacturers a high flexibility in the process chain and an associated reduction in the production costs. Therefore, development is tending toward a modularization of the components and toward an integration of additional functions in the components. In the course of this development there have been designed, for example, camshaft modules in which one or two camshafts are preassembled in a bearing frame as part of the cylinder head or in a covering hood as a complete cylinder head. Such prefabricated camshaft modules need only be placed on the cylinder block when mounting the combustion engine. The only remaining manufacturing step is the mounting of traction means, in particular the toothed belt or the timing chain, on the camshaft wheel.

To ensure that the timing ratio, given by the angular position, between camshafts and crankshafts corresponds to the predetermined degree, attention must be paid when mounting the traction means on the camshaft wheel to the exact angular position of the cams acting on the valves in terms of the two camshafts with respect to the valves on the one hand and with respect to the crankshaft on the other hand. Setting the correct angle between the rotating components involved is time-consuming and negatively influences the manufacturing costs.

In order, in conventional combustion engines, to be able to fix the angular position of the camshafts for mounting, it is known from WO2004/106716 A1 to secure a camshaft with a bolt which is guided through the cylinder head from above and which engages through a bore or a notch in the camshaft and is fixed in the cylinder block. The bolt can also assume the function of a mounting aid when assembling the engine. However, the design measures on the camshaft are great and negatively affect the stability of the camshaft. In addition, handling the bolt is uncomfortable insofar as the bore or notch in the camshaft cannot be seen from outside.

DE 10 2007 056 608 A1 discloses a tool which is used only during repairs in order to temporarily fix the position of the camshafts that exists prior to demounting a V-belt or timing chain. This tool engages in the teeth of the toothed wheel and is braced against the engine block by means of a screw. However, this tool only allows a provisional and temporary fixing of the camshafts. The engagement of the tool in the toothed wheel functional surface can also lead to damage or to remaining abrasion on the camshaft wheel.

DETAILED DESCRIPTION

Figure 1:
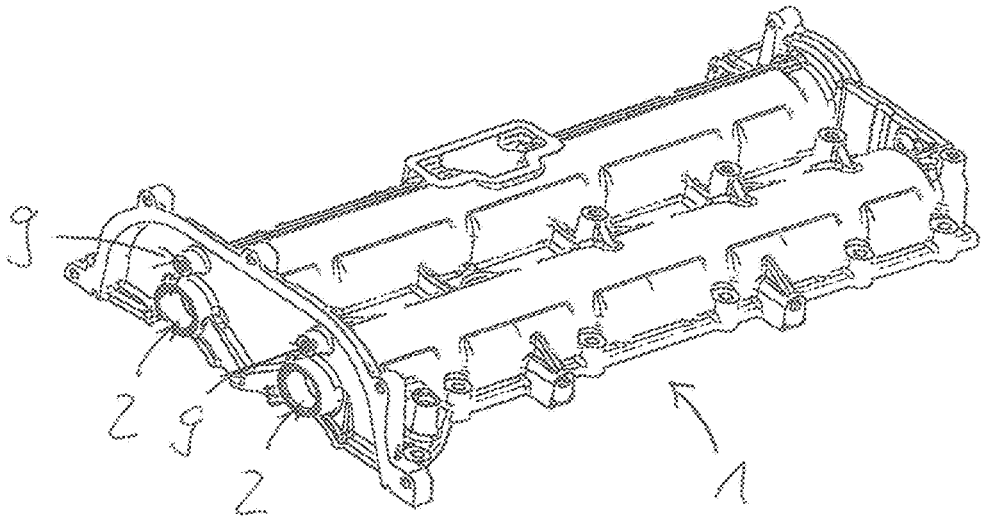
FIG. 1 is a perspective view of an example covering hood for receiving two camshafts.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element.

The present disclosure generally concerns a module that in some examples may comprise a receiving element, in the form of a bearing frame or a covering hood, for instance, for arrangement on a cylinder head of an internal combustion engine. The module may additionally have at least one camshaft that is rotatably mounted in the receiving element and which, for holding a camshaft wheel, projects out of a face side of the receiving element. Moreover, the module may be prefabricated for direct mounting on the cylinder head.

One example object of the present disclosure is to provide a cost-effective module of simple design comprising a receiving element and one or more camshafts which, within the scope of mounting of internal combustion engines, is to be mounted in few steps. Another example object is to reliably ensure the fixing of the camshaft(s) in a predetermined angular position until the mounting of a traction means on the camshaft wheel. Still another example object of the present disclosure is to provide for simple termination of the fixing after mounting.

It should be understood that one aspect of the present disclosure aims to ensure particularly simple and rapid mounting for the prefabricated module consisting of receiving element and camshaft(s) using the securing part which engages in the camshaft wheel. Here, the particular feature consists in the fact that the securing part engages in the externally accessible camshaft wheel while protecting its toothed rim and, despite a simple mechanical design, fixes it particularly reliably with respect to the receiving element. Consequently, the angular position of the camshafts which is predetermined for the installation of the module is reliably fixed.

Here, the module is prefabricated for direct mounting on the cylinder head of a combustion engine in accordance with the claims due to the fact that the cams of the camshaft are first situated in the angular position for acting on the valves that is predetermined by the correct timing ratio. In this angular position, the camshaft is locked against rotation by the securing part which is externally accessible for handling, wherein the securing part engages through an aperture in the camshaft wheel and is in positive connection, against rotation, with a receptacle provided therefor in the receiving element, with the result that the camshaft wheel is blocked with respect to the receiving element. After mounting the module on the internal combustion engine, the securing part is removed from the locking position by a simple manipulation.

Any prefabricated modules comprising a receiving element and preassembled camshafts can be equipped with the securing part designed in such a way. However, a very particularly suitable application is those modules in which the camshafts have been inserted into correspondingly coaxially arranged through-bores in the receiving element using thermal shrinking and expansion processes. In this joining process, the body of the camshaft is first cooled and thus shrunk to such an extent that it can be inserted into the through-bores via bearings. During insertion, the cams are "threaded on" at the same time. With heating and corresponding expansion, the body of the camshaft is pressed at the intended locations into bearings and into the cams.

The substantial advantage of a module prefabricated and prepositioned in such a way is that it can be directly installed in engine assembly and that a complicated manufacturing step is saved because of the reliable fixing of the camshafts. Here, the use of the securing part according to the invention ensures a particularly gentle (since it does not act on the toothed rim) and nevertheless robust and precise fixing of the camshafts in the receiving element. In addition, the securing part according to the invention can be handled particularly simply during installation and during removal.

Advantageously, the camshaft wheel, which is in particular a toothed wheel or belt (wheel), is designed from the outset specifically for the use of a securing part which can be handled particularly simply. For this purpose, the disk surface of the wheel is breached by a first aperture at least at one point apposite to an element of the securing part that engages through, wherein it is structurally particularly simple if this first aperture is formed as a cylindrical bore which is penetrated by a complementarily formed cylindrical pin of the securing part. The pin then reaches into a further receptacle, provided in the receiving element, in the form of a bore which at the correct angular position is aligned with the bore in the camshaft wheel. Here, care must be taken in each case to ensure a corresponding fit which allows the sliding of the pin in spite of a radial positive connection which is as strong as possible.

In addition, it is advantageous for there to be provided in the disk surface at least one second aperture for holding the securing part, wherein the securing part is equipped with a corresponding holding means which interacts with the second aperture. The holding means thus fixes the securing part mounted in the camshaft wheel and prevents the axial displacement of the pin in the process.

In a particularly advantageous embodiment, the holding means is equipped at least with a flexible clip leg on whose end there is situated a latching lug. The clip leg engages in the second aperture, with the latching lug engaging behind the edge of the aperture if the holding means is in contact on the other side with the outer surface of the camshaft wheel.

Ideally, the holding means has two clip legs which are connected via a tilt joint and correspondingly engage in a latching manner in two apertures. Here, —as in the case of a clothes peg—a spring action is to be provided which closes the two clip legs. The two ends of the clip legs that are equipped with the latching lugs thus form a clip head and the other ends of the clip legs form externally accessible handles. Owing to the tilt joint, pressing together the grips brings about an opening and thus an unlocking of the clip head.

It is particularly advantageous if the securing part, which is equipped in particular with the pin and the two clip legs connected resiliently via the tilt joint, are manufactured as a one-piece plastic injection-molded part. On the one hand, such a securing part can be produced simply and cost-effectively and can be treated as a disposable article. Moreover, it combines low weight with high stability. An essential advantage is that the pin can be manufactured with a high fit accuracy and, owing to the difference in material, can be easily inserted into the bore. With regard to the simple sliding in the bores combined nevertheless with a high fit accuracy, and to compensate for any manufacturing tolerances, it is particularly advantageous to equip the walls of the pin with axial slots which produce a limited radial flexibility.

In a further advantageous embodiment, the securing part is provided with a tamper-evident means, for example a seal, which breaks during first-time removal of the securing part from the locking position and thus makes visible the manipulation. Such a tamper-evident means makes it possible during installation of the module to ensure that it is a module in the original state in which the correct angular position is guaranteed.

FIG. 1 first shows, as part of a module equipped according to the invention, a receiving element in the form of a prefabricated covering hood 1 which is suitable for placing on a cylinder head of an internal combustion engine. Two bores 2 are made in one face of the covering hood 1, out of which bores there correspondingly project two camshafts 16 (see FIG. 5) to be mounted rotatably in the covering hood 1. A receptacle 9 in the form of a securing bore which receives the securing part is made in the face of the covering hood 1 above each bore 2.

Figure 2:
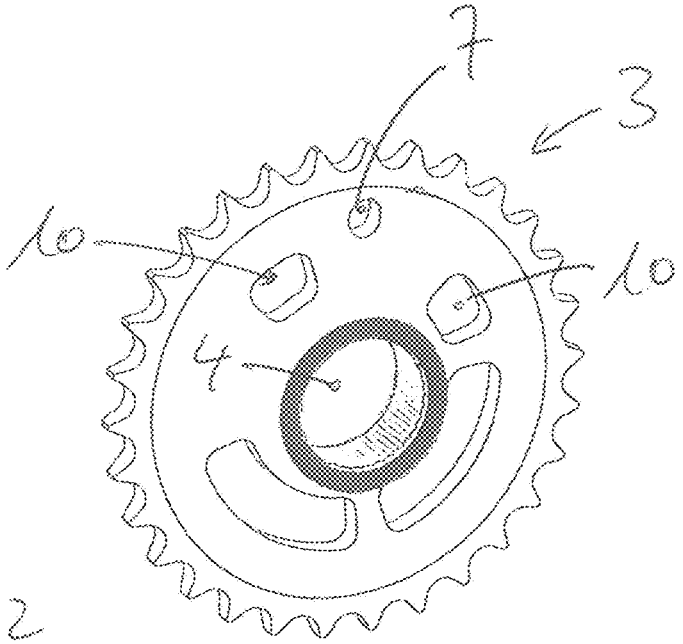
FIG. 2 is a perspective view of an example camshaft wheel with openings.

FIG. 2 shows a camshaft wheel 3 equipped according to the invention in the form of a toothed wheel as is mounted by means of a central bore 4 on ends of the camshafts 16 that project on the face out of the bores 2 of the covering hood 1. The module shown in FIG. 5, consisting of the covering hood 1, the two camshafts 16 and the camshaft wheels 3, is prefabricated for direct mounting on the cylinder head of an internal combustion engine.

Figure 3:
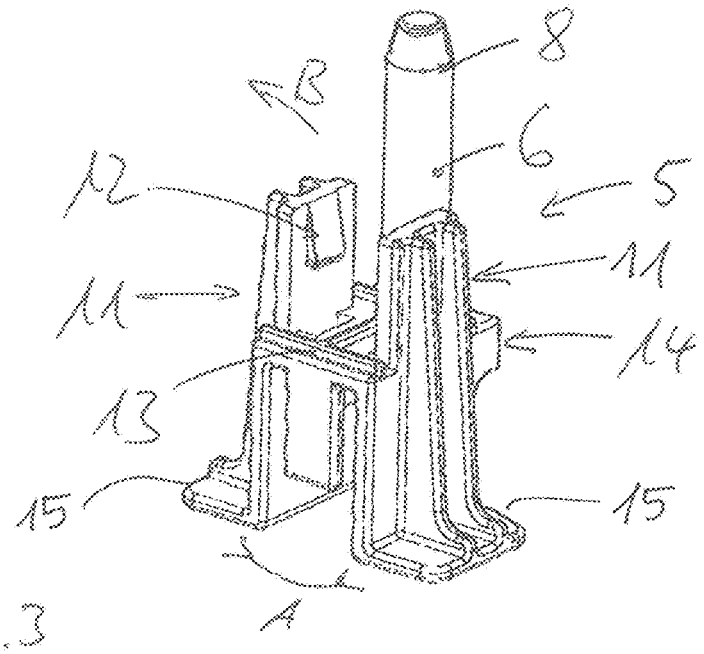
FIG. 3 is a perspective view of an example securing part produced in one piece from plastic.

For mounting, each of the camshafts is locked against an unintended rotation before or during mounting by an externally accessible plastic securing part 5, illustrated in FIG. 3, in the angular position which is correct for acting on the valves. For locking, the securing part 5 mounted on the camshaft wheel 3 first of all penetrates by way of a pin 6 through an aperture 7 in the form of a through-bore made in the inner disk of the camshaft wheel 3 seated on the camshaft 16. In the process, the pin 6 reaches through the through-bore and by way of its tip 8 into the receptacle 9 (FIG. 1), configured as a securing bore, in the covering hood 1.

The tip 8 of the securing part 5 is in radial positive connection with the receptacle 9 and fixes the camshaft 16 against rotation. Here, the through-bore 7 and the receptacle 9 are dimensioned in their diameter such that they form a sliding fit for the pin 6. The securing part 5 is designed overall such that, after mounting the module on the cylinder head, it can be removed from its formerly locking position with a simple manipulation. In the present case, the securing part 5 is completely removed and can be disposed of or reused.

Figure 4:
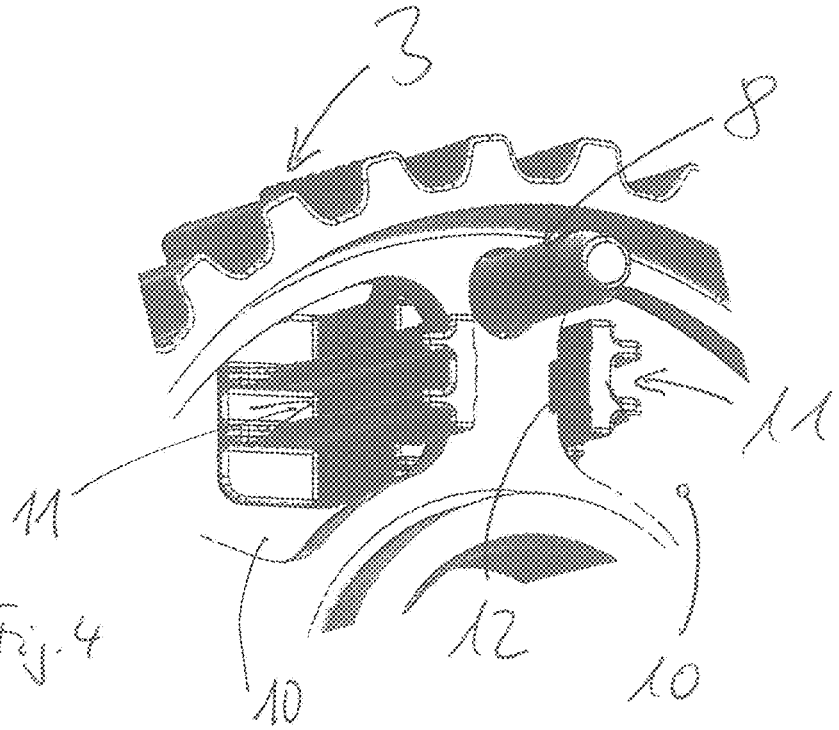
FIG. 4 is a partial perspective view of an example securing part mounted in an example camshaft wheel.

To retain the securing part 5 on the camshaft wheel 3 (see also FIG. 4), two second apertures 10 arranged symmetrically around the through-bore 7 are provided in the surface of the camshaft wheel 3. A flexible clip leg 11 with which the securing part 5 is equipped engages in each of these second apertures 10. Each clip leg 11 has a latching lug 12 which engages behind an edge of the respective aperture 10. The securing part 5 lies by way of a bearing surface 13 against the front edge of the aperture 10 and thus against the surface of the camshaft wheel. The securing part 5 with the pin 6 and the two clip legs 11 is injection-molded in one piece from plastic, with the two clip legs 11 being integrally formed on a bridge part 14 forming the bearing surface 13 in such a way that the connection forms a resilient tilt joint.

The spring force produced by the one-piece construction closes the clip legs 11, with the result that the latching lugs 12 latch in with the securing part 5 mounted. The ends of the clip legs 11 that are equipped with the latching lugs 12 form as it were a clip head. By contrast, the other ends of the clip legs form two externally accessible handles 15 which, when pressed together in arrow direction A, open the clip head (arrow B).

Figure 5:
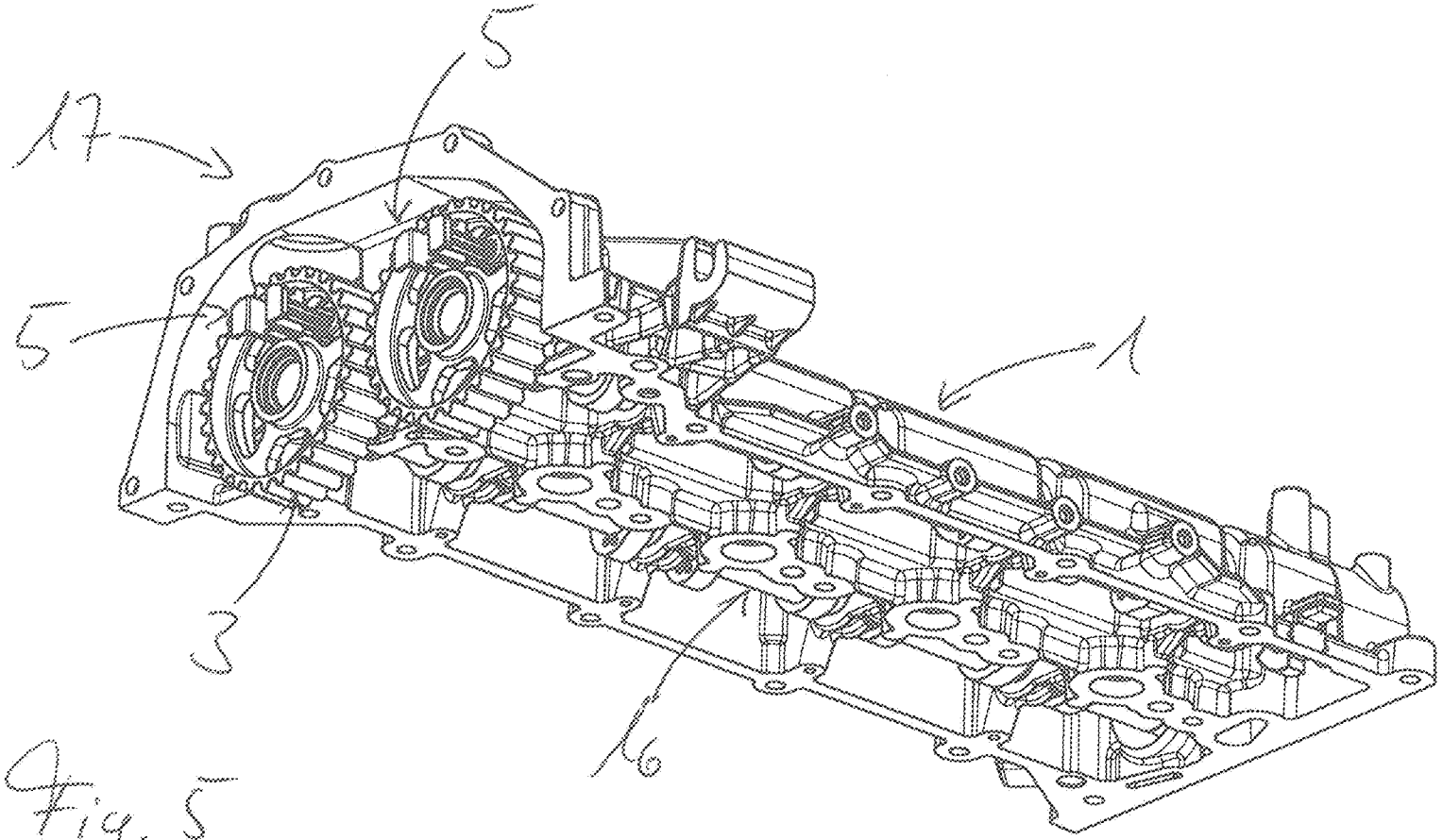
FIG. 5 is a perspective view of an example module including a covering hood and installed camshafts.

FIG. 5, now, shows the module with the covering hood 1 and two camshafts 16 which are mounted therein and of which the ends project out of an end side 17 of the covering hood 1 and carry the camshaft wheels 3. The module is prefabricated insofar as the camshafts 16 are secured against rotation in the predetermined angular position by means of the securing parts 5 used. This module can be mounted directly on the cylinder head of an internal combustion engine.

What is claimed is:

1. A module comprising:

a receiving element configured as a bearing frame or a covering hood and is sized and shaped to mount to a cylinder head of an internal combustion engine, the receiving element comprising a receptacle;

a camshaft rotatably mounted on the receiving element, wherein the camshaft projects out of a face of the receiving element;

a camshaft wheel fixedly mounted on the camshaft, the camshaft wheel including a first aperture formed therethrough and a second aperture formed therethrough; and a securing part that is accessible when the receiving element is mounted to the cylinder head, the securing part comprising a pin configured to lock the camshaft against rotation in an angular position when the pin extends through the first aperture and through or into the receptacle of the receiving element, wherein the securing part further includes a catch that is configured to extend through the second aperture, engage the camshaft wheel, and axially secure the pin in position when the catch is so engaged.

2. The module of claim 1 wherein the camshaft wheel is a toothed wheel or a belt wheel wherein the first aperture is configured as a bore sized and shaped to receive the pin, wherein a sliding fit is provided between the pin and the bore, wherein the pin extends through the bore into the receptacle in the receiving element, wherein the receptacle in the receiving element is configured as a securing bore.

3. The module of claim 1 wherein the securing part is manufactured as a one-piece plastic injection-molded part.

4. The module of claim 3 wherein the pin has an axially slotted wall configured to limit radial flexibility.

5. The module of claim 1 wherein the catch comprises a flexible clip leg with a latching lug, wherein the flexible clip leg engages in the second aperture in the camshaft wheel, wherein the latching lug engages behind an edge of the second aperture.

6. The module of claim 5 wherein the flexible clip leg is a first flexible clip leg, the catch further comprising a second flexible clip leg with a latching lug, with the first and second flexible clip legs being connected via a tilt joint and closeable by a spring force, wherein the latching lugs are disposed at one end of the first and second flexible clip legs and form a clip head, wherein externally accessible handles are disposed at an opposite end of the first and second flexible clip legs, wherein pushing the externally accessible handles together causes the clip head to open.

7. The module of claim 1 wherein the receiving element comprises bores for receiving the camshaft, wherein a body of the camshaft is inserted into the bores of the receiving element via rotary bearings in a joining process that uses thermal expansion.

8. The module of claim 1 wherein the camshaft is a first camshaft and the securing part is a first securing part, the module further comprising a second camshaft and a second securing part, wherein the first and second camshafts are rotatably mounted in the receiving element, wherein cams of the first and second camshafts are positioned to act on two rows of valves, wherein the first and second camshafts are locked against rotation in angular positions by the first and second securing parts, at least before the securing parts are removed.

9. A module comprising:

a receiving element configured as a bearing frame or a covering hood and configured to be mounted on an internal combustion engine, the receiving element comprising a receptacle;

a camshaft rotatably mounted on the receiving element, wherein the camshaft projects from the receiving element;

a camshaft wheel coupled to the camshaft, the camshaft wheel including a first aperture formed therethrough and a second aperture formed therethrough; and a securing part that remains accessible when the receiving element is mounted on the internal combustion engine, wherein the securing part is removable, wherein the securing part comprises a pin configured to maintain the camshaft in an angular position and prevent the camshaft from rotating, wherein prior to removal the pin extends through the first aperture of the camshaft wheel and through or into the receptacle of the receiving element, wherein the securing part further includes a catch that is configured to extend through the second aperture, engage the camshaft wheel, and axially secure the pin in position when the catch is so engaged.

10. The module of claim 9 wherein the camshaft wheel is configured as a toothed wheel or a belt wheel.

11. The module of claim 9 wherein the catch comprises two flexible clip legs, the two flexible clip legs each including a latching lug.

12. The module of claim 11 wherein the securing part further comprises two handles configured such that squeezing the two handles towards one another causes the latching lugs of the two flexible clip legs to separate and disengage from the camshaft wheel.

13. A securing part for releasably maintaining a camshaft rotatably mounted on a receiving element in an angular position, the securing part comprising:

a bridge part;

a pin extending from the bridge part;

two flexible clip legs extending from the bridge part on opposite sides of and along the pin, the two clip legs each including a latching lug; and two handles extending from the bridge part in a direction opposite the pin, wherein squeezing the two handles towards one another causes the latching lugs of the two flexible clip legs to separate.

* * * * *